US006519849B2

(12) United States Patent
Endres

(10) Patent No.: US 6,519,849 B2
(45) **Date of Patent: *Feb. 18, 2003**

(54) METHOD FOR THE MANUFACTURE OF A WELDED ROTOR OF A FLUID-FLOW MACHINE

(75) Inventor: Wilhelm Endres, Remetschwil (CH)

(73) Assignee: Alstom (Switzerland) Ltd, Baden (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/456,333

(22) Filed: Dec. 8, 1999

(65) Prior Publication Data

US 2002/0092165 A1 Jul. 18, 2002

(30) Foreign Application Priority Data

Dec. 10, 1998 (EP) ..... 98811218

(51) Int. Cl.[7] ..... B21K 25/00
(52) U.S. Cl. ..... 29/889.21; 29/889.2
(58) Field of Search ..... 29/889.2, 889, 29/889.21, 889.22, 525.13, 525.14; 219/121.14; 415/115, 175, 176; 416/198 R, 198 A

(56) References Cited

U.S. PATENT DOCUMENTS 4,396,820 A * 8/1983 Puschner ..... 219/121.14
4,598,449 A * 7/1986 Monhardt et al. ..... 219/121.14
5,221,821 A * 6/1993 Burns et al. ..... 219/121.14
5,507,620 A 4/1996 Primoschitz et al.
5,593,274 A * 1/1997 Carreno et al. ..... 415/115
5,632,600 A * 5/1997 Hull ..... 416/198 A
5,833,244 A * 11/1998 Salt et al. ..... 416/198 A
5,865,600 A * 2/1999 Mori et al. ..... 416/198 A
5,993,154 A * 11/1999 Endres et al. ..... 415/115

FOREIGN PATENT DOCUMENTS

EP 0844367 A1 5/1998
GB 1549070 7/1979

* cited by examiner

*Primary Examiner*—Gregory M. Vidovich
*Assistant Examiner*—T. Nguyen
(74) *Attorney, Agent, or Firm*—Burns, Doane, Swecker & Mathis, L.L.P.

(57) ABSTRACT

A method for manufacturing a welded rotor of a fluid-flow machine are described, through which rotor a coiling medium flows through inflow and outflow passages inside the rotor and which is composed of a plurality of rotor disks, which are connected to one another by welds running radially or largely radially relative to the rotor axis and in each case enclose with one another a hollow passage, which runs around the rotor axis and interrupts the welds in such a way that a weld facing the rotor is directly adjacent to the hollow passage.

11 Claims, 2 Drawing Sheets

METHOD FOR THE MANUFACTURE OF A WELDED ROTOR OF A FLUID-FLOW MACHINE

FIELD OF THE INVENTION

The invention relates to a method for the manufacture of a welded rotor of a fluid-flow machine.

BACKGROUND OF THE INVENTION

A welded rotor of the generic type for a fluid-flow machine, for example for a gas-turbine plant, is described in European publication EP 0 844 367 A1. For cooling purposes, the rotor has hollow passages 5, 5*a*, 5*b*, etc., which extend around the rotor axis between two rotor disks welded to one another. With regard to the technical necessity of the hollow passages encircling the rotor axis, reference may be made to the abovementioned European publication, to which in addition reference is made with regard to all the details which are not described in full and which are required for the technical understanding of the cooling system on which the welded rotor is based.

In each case a specially designed insert ring 20, which at least partly defines each hollow passage on one side and is firmly welded to the rotor disks via appropriate welds, is provided for the peripheral sealing of the hollow passages 5, 5*a*, 5*b*, which for cooling purposes encircle the rotor described above (in this respect see FIG. 1 of the abovementioned European publication).

The geometrical design of the hollow space as well as the form of the insert rings are selected in such a way that work may be carried out with conventional welding techniques in order to produce the welds. Although this meets the desire for manufacturing techniques and conditions which are as simple as possible in the production and manufacture of welded rotors, the manufacture of the insert rings specially adapted to the geometry of the hollow passages requires high precision and high accuracy of alignment during assembly, as a result of which the manufacturing costs are in turn considerable. In addition, the insert rings each have a distance web, which projects into the interior of the hollow passage and impairs the free spreading of the cooling medium inside the hollow passage. These measures have been selected for reasons of simplified assembly with the use of conventional welding techniques. However, wake spaces, in which the cooling medium may collect or be trapped, inevitably form, as a result of which material damage cannot be ruled out.

SUMMARY OF THE INVENTION

Accordingly, one object of the invention is to develop a novel method for the manufacture of a welded rotor of a fluid-flow machine in such a way that, on the one hand, the individual components which are required for the assembly of the rotor are as simple and as cost-effective to produce as possible and are easy to join inside the rotor to be welded on the other hand. In particular, according to the present invention it is possible to fully utilize the advantages which are obtained, for example, by means of electron-beam welding. The manufacturing method is to work reliably with a higher process speed than is the case with the hitherto known methods for the manufacture of welded rotors of the generic type.

The method according to the invention for the manufacture of a welded rotor of a fluid-flow machine, through which rotor a cooling medium flows through inflow and outflow passages inside the rotor and which is composed of a plurality of rotor disks, which are connected to one another by welds running radially or largely radially relative to the rotor axis and in each case enclose with one another a hollow space, which runs around the rotor axis and interrupts the welds in such a way that a weld facing the rotor is directly adjacent to the hollow space, is developed by the following steps:

Two rotor disks directly adjacent to one another are firmly joined to one another along their mutual contact surfaces, preferably along a weld, for example with the use of conventional welding techniques. Like the abovementioned case of a welded rotor according to the teaching from European publication EP 0 844 367 A1, the two adjacent rotor disks, in the joined-together state, enclose a hollow passage, whose peripheral outside remote from the rotor axis is designed to be at least partly open. In addition, the rotor disks are designed in such a way that the enclose a gap, which directly adjoins the hollow space on the side facing away from the rotor and into which a ring element comprising at least two components is inserted. Both ring parts are then firmly joined to one another at their abutting surfaces inside the gap by means of electron-beam welding. Likewise, the side flanks of the components of the ring element which are fitted into the gap are firmly joined to the respective rotor disks by means of electron-beam welding.

By means of the method according to the invention, it is possible, with the use of the electron-beam welding technique and in virtually a single process step, to radially seal off to the outside the hollow passage, encircling the axis of rotation, between two rotor disks to be welded. To this end, a preferably two-piece ring is placed from outside into the open gap of the two rotor disks to be welded, the abutting surfaces of the ring parts being subsequently welded to one another by means of an electron beam. The side flanks of the ring elements are likewise welded to the corresponding rotor disks. This is possible with the use of electron-beam welding, since a welding process acting in the depth of the material is ensured by means of this technique.

In order to optimize the welding operation itself, centering lips, within which the welding beam is guided, are provided at the points to be welded.

Unlike the method described above, a further alternative method according to the invention for the manufacture of a welded rotor, of the generic category, of a fluid-flow machine provides for no splitting of the ring element, but rather uses a one-piece ring for closing off the hollow space at its peripheral outside. In addition, the method described below offers the possibility of also carrying out the joining operation with conventional welding techniques, for example by means of inert-gas, induction, ultrasonic or arc welding, just to mention a few alternative welding techniques.

To this end, a one-piece ring is inserted between two rotor disks to be welded before the two rotor disks are firmly welded to one another. In this case, one rotor disks provides a fixed stop surface, against which the one-piece ring, with one of its two opposite side flanks, abuts in a flush-fitting manner. The other rotor disks, on the other hand, is designed in such a way that the one-piece ring can be pushed at least a short distance over the other rotor disk. Here, the other rotor disks, adjacent to the hollow passage, which is formed by the joining of the two rotor disks, has an outside diameter which is smaller than the inside diameter of the one-piece ring.

The two rotor disks to be joined to one another are welded along at least one weld, which extends in the direction of the rotor axis starting from the hollow passage, which is enclosed by both rotor disks. During this welding operation, the one-piece ring is displaced in the direction of the rotor disk which, in the region of the hollow passage, has the outside diameter, described above, which is somewhat smaller than the inside diameter of the ring.

In this way, welding which is accessible from outside is possible at the weld point between the one and the other rotor disks, especially as the welding operation takes place through the hollow passage, which is open at the top.

For this operation, it is of advantage if the ring is fixed in its position described above by local sport welding. Other measures may of course also be taken in order to hold the ring in a position remote from the hollow passage during the welding.

Furthermore, the ring is released from its spot-welding point and pressed with its two side flanks against the fixed stop surface of the rotor disks. The welding operation to be carried out subsequently may be effected in the same way as in the case described above by means of electron-beam welding; conventional welding techniques may of course also be used.

In the state in which the ring bears against the stop surface of the rotor disks, this ring is welded to the rotor disks. If conventional welding techniques are used, first of all the bottom region between the fixed stop surface and the ring, the so-called root region, is welded. In this way, sufficient fixing of the ring to the stop surface of one rotor disks is ensured. The ring is subsequently partly or completely welded to the other rotor disk, so that the hollow passage open on one side is completely closed by the ring and the subsequent welding operations. Finally, the remaining intermediate gap between the fixed stop surface of one rotor disks is filled with the ring.

The manufacturing methods according to the invention and described above relate to a simplified assembly of welded rotors which provide cooling passages inside the rotor shaft for cooling purposes, cooling steam being driven through these cooling passages. Of decisive advantage is the utilization of the advantages associated with the electron-beam welding technique.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
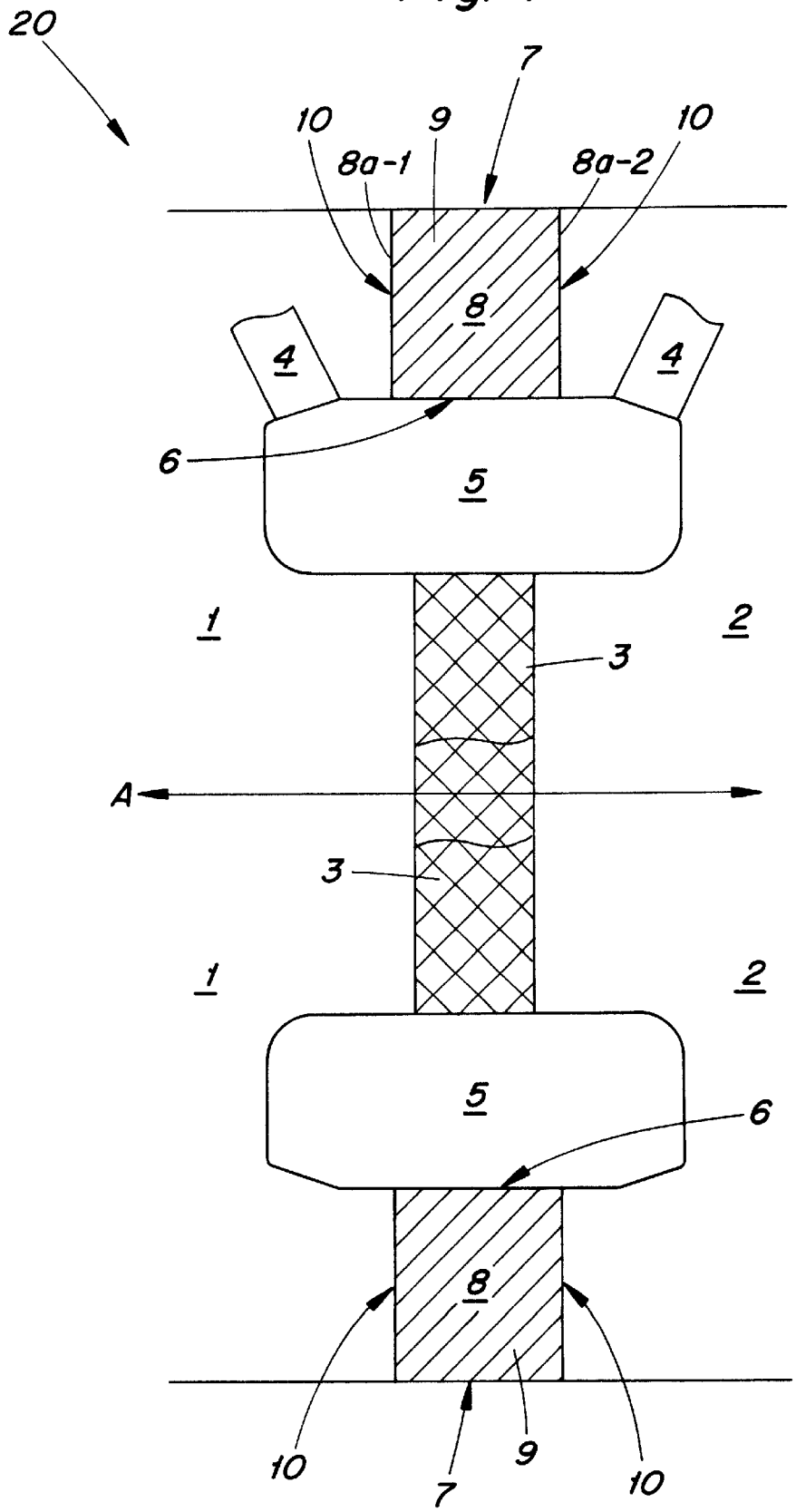
FIG. 1 shows a cross section through a hollow passage welded according to the invention by means of electron-beam welding technique.

Referring now to the drawings, wherein like reference numerals designate identical or corresponding parts throughout the several views, FIG. 1, in a highly schematic representation, shows a cross-sectional view of a welded rotor 20 having a rotor axis A through the adjacent regions of two rotor disks 1, 2 to the hollow passage 5, through which a cooling medium is driven. The hollow passage 5 is defined on the one hand by the rotor disks 1 and 2, which are firmly connected to one another under the hollow passage 5 by a weld 3. Opening out on the right and left at the hollow passage 5 are cooling passages 4, which accordingly pass through the rotor disks 1 and 2 and through which cooling medium can be directed into or discharged from the hollow passage 5.

To manufacture the rotor disks 1 and 2 shown in FIG. 1 and welded to one another, these rotor disks 1 and 2 are first of all firmly joined to one another along the weld 3. This welding operation may be obtained either with conventional welding techniques or with electron-beam welding.

The hollow space 5 enclosed by the two rotor disks 1 and 2 is designed to be open on its peripheral outside in the region 6. On the side remote from the rotor, the rotor disks 1 and 2 enclose a gap 7 adjacent to the hollow passage, through which gap 7 the welding beam required for the welding of the two rotor disks 1 and 2 for producing the weld 3 during electron-beam welding can be directed.

In the state in which the two rotor disks 1 and 2 are already joined together along the weld 3, a preferably two-piece ring element 8 is inserted radially from outside into the gap 7, and this ring element 8 is firmly welded at its opposite abutting edges 9 by means of electron-beam welding. The two-piece ring element 8 includes side flanks **8*a*-1 and 8*a*-2. As may be seen with reference to FIG. 1, the side flank 8*a*-1 abuts the rotor disk 1 while the side flank 8*a*-2 abuts the rotor disks 2. During manufacturing, the side flanks 8*a*-1 and 8*a*-2 weld to the rotor disks 1 and 2, respectively. Likewise, the electron-beam welding is able to produce a fixed connection along the circumferential welds 10 and in this way produce a fixed connection between the ring elements 8 and the rotor disks 1 and 2**.

In order to make the electron-beam welding operation mode reliable, in particular with regard to the production of clean welding grooves, so-called centering lips 11 are provided along the separating edges to be welded, and these centering lips 11 serve to avoid through-weld points, which are often associated with bulging and material-droplet formation directly at the welding groove.

Figure 2:
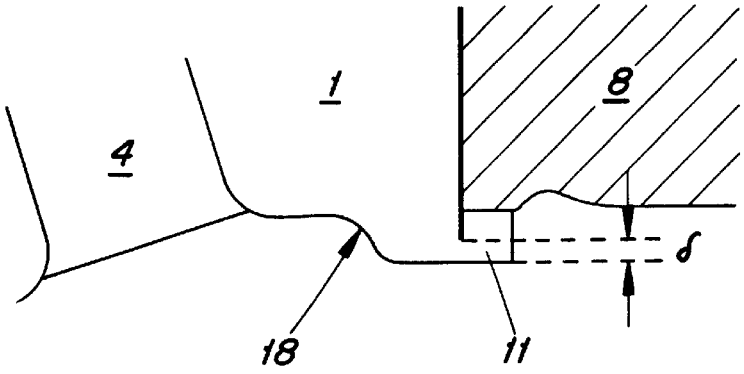
FIG. 2 shows a schematic representation of a centering lip.

A detail representation of the bottom end of the circumferential weld 10 according to FIG. 1 is shown in FIG. 2. A small projection, designated as centering lip 11, is attached to the bottom end of the circumferential weld 10 of the rotor disk 1 and projects slightly beyond the ring element 8 at its underside. During the welding, the centering lip 11 is not completely welded through, as can be seen from the detail representation according to FIG. 2. Typically, a distance $\delta$ of about 2–5 mm remains between beam end or weld end and inner contour. In addition, in order to compensate for axially directed stresses, relief grooves 18 are provided. As may be seen with reference to FIGS. 2 and 3, the relief grooves 18 include a concave contour which directly adjoins a reinforcement bead. The relief groove 18 provides a smooth transition from the weld 14 to a contour of the adjoining part. As those skilled in the art will appreciate, the smooth transition formed by the relief grooves 18 compensates for axially directed stresses.

In contrast to the method described with reference to FIG. 1 for joining two rotor disks with the use of the electron-beam welding technique, an alternative method which, on the one hand, needs only conventional welding techniques and, on the other hand, provides for the use of a one-piece ring for closing off the hollow passage from its peripheral outside is described below with reference to FIG. 3.

The rotor disks 1 and 2 are to be joined. The rotor disks 2, in the region adjacent to the hollow passage 5, has an outer contour whose outside diameter 12 is somewhat smaller than or equal to the inside diameter 13 of the ring element 8 of one-piece design. In this way, the ring element 8 can be displaced at least a short distance to the right over the rotor disk 2.

Figure 3:
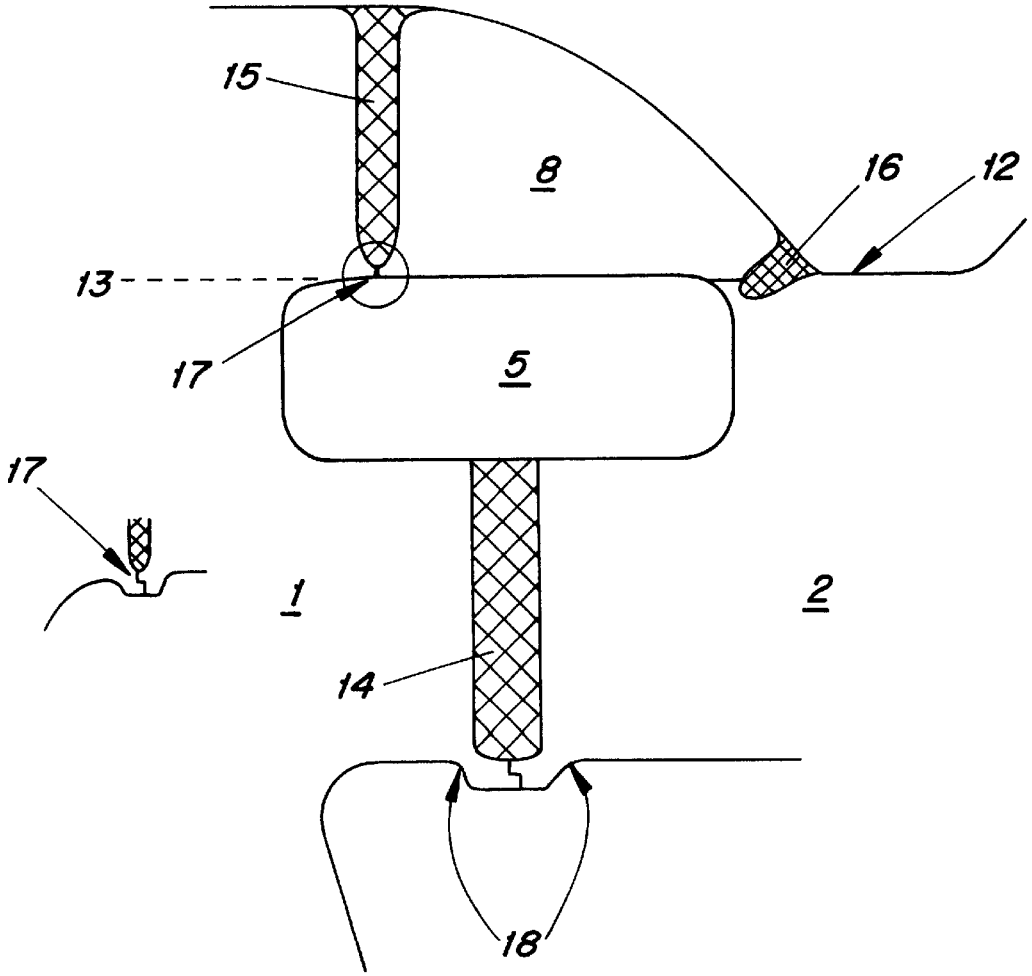
FIG. 3 shows a schematic cross-sectional representation through a welded rotor having a hollow passage with a one-piece ring as sealing element of the hollow passage.

Three welds 14, 15 and 16 are provided in order to join the rotor disks 1 and 2 shown in FIG. 3.

First of all the one-piece ring 8 is pushed over the rotor disks 2 and provisionally fastened there, for example by means of a spot-welded connection. The rotor disk 1 is then placed against the rotor disk 2 and the weld 14 is executed, and the weld 14 may be examined subsequently by means of quality inspection methods known per se. Thus a rough surface overfill normally forms on the weld surface and may be reworked by means of suitable material-removal techniques, such as for example grinding or turning, to form a smooth surface.

After completion of the weld 14, which, as already mentioned above, may be produced by means of conventional welding techniques, the ring 8 is displaced to the left until the ring abuts against a centering lip 17 of the rotor disk 1 in a flush-fitting manner (in this respect see the detail representation in FIG. 3). For initial fixing, it is sufficient if the ring 8 and the rotor disk 1 are welded to one another in the root region, which is normally effected under inert-gas conditions. The weld 15 may then be filled immediately afterward. Finally, the weld 16 which firmly connects the ring 8 to the rotor disk 2 is filled.

Due to the displaceability of the ring 8 over the outer contour of the rotor disk 2, it is possible to produce three welds in a conventional manner in order to finally close a hollow space 5 between the rotor disks 1 and 2. The requisite space is usually available at the end of rotor parts.

The methods according to the invention which are described above lead to welded rotors having encircling hollow passages in which no surface elements impairing the cooling medium inside the hollow space during spreading are provided.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by letters patent of the United States is:

1. A method for the manufacture of a welded rotor of a fluid-flow machine, through which rotor a cooling medium flows through inflow and outflow passages inside the rotor and which is composed of a plurality of rotor disks, the method comprising applying a plurality of welds running radially relative to a rotor axis of the rotor and the welds enclose with one another to form a hollow passage which extends around the rotor axis and interrupts the plurality of welds in such a way that at least one weld facing the rotor is directly adjacent to the hollow passage, wherein two of the rotor disks directly adjacent to one another are welded to one another along at least one weld, the at least one weld extending in the direction of the rotor axis starting from the hollow passages, which is enclosed by both rotor disks, wherein a region of the hollow passage which faces away from the rotor is designed to be at least partly open at its peripheral outside, and wherein both rotor disks enclose a gap which directly adjoins the hollow passage on the region facing away from the rotor; and inserting at least two components of a ring element into the gap whereby the at least two components of the ring element are joined to one another at opposite abutting surfaces of the at least two components of the ring element and with side flanks of the at least two components of the ring element joined to the rotor disks.

2. The method as claimed in claim 1, wherein the opposite abutting surfaces of the at least two components of the ring element are joined to one another by means of electron-beam welding.

3. The method as claimed in claim 2, wherein the method further comprises forming a relief groove to relieve a weld produced during the welding.

4. The method as claimed in claim 2, wherein the method further comprises providing a centering lip at welding points formed during welding wherein the centering lip, which is not cut through by the welding beam, provides a projection at a weld surface of both parts to be welded.

5. The method as claimed in claim 1, wherein the weld extending in the direction of the rotor axis starting from the hollow passage, which is enclosed by the two rotor disks, is formed as a surface weld.

6. A method for the manufacture of a welded rotor, the method comprising:

providing a rotor having a plurality of rotor disks, the rotor including inflow passages and outflow passages where a cooling medium flows through both the inflow passages and the outflow passages;

forming a hollow passage by applying a plurality of welds to the rotor where the plurality of welds run radially relative to a rotor axis of the rotor such that welds of the plurality of welds enclose with one another to form the hollow passage, the hollow passage extending around the rotor axis and the hollow passage interrupting the plurality of welds such that at least one weld facing the rotor is adjacent to the hollow passage;

forming a gap by welding two adjacent rotor disks along at least one weld thereby enclosing the hollow passage, the at least one weld extending in a direction of the rotor axis starting from the hollow passage where the two adjacent rotor disks are welded such that a region of the hollow passage which faces away from the rotor is at least partly open at a peripheral outside of the hollow passage and the gap directly adjoins the hollow passage on the region facing away from the rotor;

inserting at least two components of a ring element into the gap wherein the periphery of the ring element is planar with a periphery of the plurality of the rotor disks;

joining the at least two components of a ring element to one another at opposite abutting surfaces of the at least two components of a ring element; and joining the at least two components of a ring element with the two adjacent rotor disks at a side flank of the at least two components of a ring element thereby forming the welded rotor.

7. The method as claimed in claim 6, wherein the opposite abutting surfaces of the at least two components of the ring element are joined to one another by means of electron-beam welding.

8. The method as claimed in claim 7, wherein the method further comprises forming a relief groove to relieve the weld produced during the welding.

9. The method as claimed in claim 7, wherein the method further comprises providing a centering lip at welding points formed during welding wherein the centering lip, which is not cut through by the welding beam, provides a projection at a weld surface of both parts to be welded.

10. The method as claimed in claim 6, wherein the weld extending in the direction of the rotor axis starting from the hollow passage, which is enclosed by the two rotor disks, is formed as a surface weld.

11. The method as claimed in claim 6, wherein the side flanks of the at least two components of a ring element are joined to the two adjacent rotor disks with electron beam welding.

* * * * *